US007310829B1

(12) United States Patent
Engel-Wilson

(10) Patent No.: US 7,310,829 B1
(45) Date of Patent: Dec. 25, 2007

(54) NECK GUARD ACCESSORY FOR BASEBALL CAPS AND THE LIKE

(76) Inventor: Ronald W. Engel-Wilson, P.O. Box 1545, 1080 River Bluff Rd., Idabel, OK (US) 74745

( * ) Notice: Subject to any disclaimer, the term of this patent is extended or adjusted under 35 U.S.C. 154(b) by 170 days.

(21) Appl. No.: 11/301,796

(22) Filed: Dec. 14, 2005

(51) Int. Cl.
*A42B 1/24* (2006.01)

(52) U.S. Cl. ..... 2/209.13; 2/175.6

(58) Field of Classification Search ..... 2/209.13, 2/175.6, 206, 207; 206/8; 224/576
See application file for complete search history.

(56) References Cited

U.S. PATENT DOCUMENTS 5,046,195 A 9/1991 Koritan
5,081,717 A 1/1992 Shedd et al.
5,201,077 A 4/1993 Dondlinger
5,355,535 A 10/1994 Bruder
5,493,734 A * 2/1996 Nieves-Rivera ..... 2/209.13
5,924,129 A * 7/1999 Gill ..... 2/172
5,950,241 A * 9/1999 Gomez ..... 2/172
6,233,745 B1 5/2001 Friesen
6,802,083 B2 * 10/2004 Yan ..... 2/209.13

* cited by examiner

*Primary Examiner*—Katherine Moran

(57) ABSTRACT

A neck guard accessory includes a body that has monolithically formed UV blocking panels. A plurality of creases define the overlapping panels into first, second and third panels respectively, which is critical for effectively allowing the user to adjust each panel independently of the other panel so that the width of the body can be modified to protect the user's neck from UV lights. A mechanism is included for attaching the body to a rear portion of the cap and a separate mechanism removably conjoins the bottom edge of the body to the top edge of the body such that a length of the body can be adjusted. A mechanism is included for storing the body at a folded position when same is detached form the cap such that the body becomes adapted to a rolled position after the first and third panels are folded inwardly over the second portion.

15 Claims, 5 Drawing Sheets

NECK GUARD ACCESSORY FOR BASEBALL CAPS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cap accessories and, more particularly, to a neck guard accessory for baseball caps and the like.

2. Prior Art

The insignia cap in the form of the traditional baseball cap, for example, is a popular headgear item. However, such a cap provides no protection to the neck and sides of the face. Spectators at winter football games generally suffer from cold wind, snow, or rain. Likewise, spectators at baseball games on hot sunny days can be exposed continuously to the sun's rays. Others who suffer from inclement weather include, but are not limited to, construction workers, policemen, golfers, delivery persons, farmers, farm workers, or others sensitive to sun.

Obviously, it would be advantageous to provide a conventional baseball cap with a means to grant protection from direct sunrays and other inclement weather conditions. The use of neck guard attachments for baseball caps is well known in the prior art. However, such neck guards still have many shortcomings that make the use thereof unlikely and unappealing. One example shows a neck guard that attached to the lower rim of a baseball cap by means of a plurality of male and female snap fasteners. Unfortunately, this limits the use of such a neck guard to caps that have either the male or the female portion of the snap fasteners already incorporated therewith.

A further example employs hook and loop fasteners as opposed to the above noted snap fasteners. Unfortunately, the apparatus requires that strips of hook and loop fasteners be permanently attached to the exterior of the cap's outer rim, which is aesthetically unpleasing, and also precludes the use of the neck guard to only baseball caps that are so equipped. In yet another example a neck guard is disclosed that employs spring loaded binder clips for allowing the neck guard to be attached to various baseball caps. However, the clips used to attach the neck guard are rigid and quickly irritate the back of a user's head where the clips are attached. Furthermore, in direct sunlight, such clips absorb heat, which leads to the user having to remove the neck guard from their baseball cap.

Accordingly, a need remains for a neck guard accessory for baseball caps and the like in order to overcome the above-noted shortcomings. The present invention satisfies such a need by providing a baseball cap neck guard accessory that is practical, novel and attractive in design, and has the ability to protect a wearer's neck from the harmful rays of the sun. Such a neck guard effectively extends over and protects a user's neck, sides of their face, and their ears. This effectively prevents the occurrence of sunburn in those areas, while also reducing their risk of developing skin cancer in those regions. The neck guard accessory also provides cooling relief from heat, and is practical and convenient as it is easily transferable from one cap to another. When not in use, the neck guard accessory for baseball caps and the like can quickly and easily be folded for storage within the user's pocket.

BRIEF SUMMARY OF THE INVENTION

In view of the foregoing background, it is therefore an object of the present invention to provide a neck guard accessory for baseball caps and the like. These and other objects, features, and advantages of the invention are provided by a neck guard accessory removably attachable to an existing cap.

The accessory includes a body that has a plurality of monolithically formed panels formed from UV blocking material. Such a body further has a centrally registered longitudinal axis extending substantially parallel to a bottom edge of the cap. The body includes oppositely seated top and bottom edges registered parallel to the axis and equidistantly spaced therefrom. Such a body further has a plurality of creases linearly formed therealong wherein the creases extend orthogonal to the axis and define the panels into first, second and third panels respectively. The body effectively covers the neck and extends from cheek-to-cheek and thereby covering the user's neck and ears. Such a body may have a uniform thickness and is preferably formed from washable material. Advantageously, the first, second and third panels overlap, which is critical for effectively allowing the user to adjust each panel independently of the other panel so that the width of the body can be modified to protect the user's neck from UV lights.

A mechanism is included for removably attaching the body directly to a rear portion of the cap such that the top edge of the body confronts and abuts the bottom edge of the cap. The attaching mechanism preferably includes a flap provided with a hook and loop fastener. Such a flap is monolithically formed with the top edge of the body and is suitably sized and shaped for wrapping about the rear portion of the cap and mating directly with an interior surface of the body. The flap is centrally registered on the second panel and has a longitudinal axis orthogonally oriented with the axis of the body. A pair of coextensively shaped straps have opposed end portions directly coupled to the top edge of the body and removably mateable with each other across a bill panel of the cap. Such straps are formed from flexible material and include hook and loop fasteners for advantageously allowing the user to quickly and efficiently adjust a position of the body about the cap. Advantageously, the present invention may be retrofitted onto a variety existing caps and the like, which is critical to advancing the intended function of the present invention.

A mechanism is included for removably conjoining the bottom edge of the body directly to the top edge of the body such that a length of the body can effectively be adjusted between a full length and one-half the full length as desired by the user. The conjoining mechanism preferably includes a first plurality of hook and loop fasteners directly connected to the bottom edge of the body and a second plurality of corresponding hook and loop fasteners directly connected to the top edge of the body. Such first and second fasteners are vertically aligned in such a manner that the body can effectively be adapted to a raised and folded position by directly engaging the first fasteners to the second fasteners. The attaching mechanism and the conjoining mechanism are simultaneously and independently adjustable.

A mechanism is included for storing the body at a folded position when the body is detached from the cap such that the body becomes adapted to a rolled position after the first and third panels are folded inwardly over the second portion. The storing mechanism preferably includes a pouch directly conjoined to an inner surface of the body. Such a pouch has a U-shape provided with an open top end. The pouch is suitably sized and shaped for receiving a major portion of the first, second and third panels therein when the bottom edge of body is folded and rolled inwardly toward the top edge. The first and second fasteners are detached when the body is stored within the pouch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
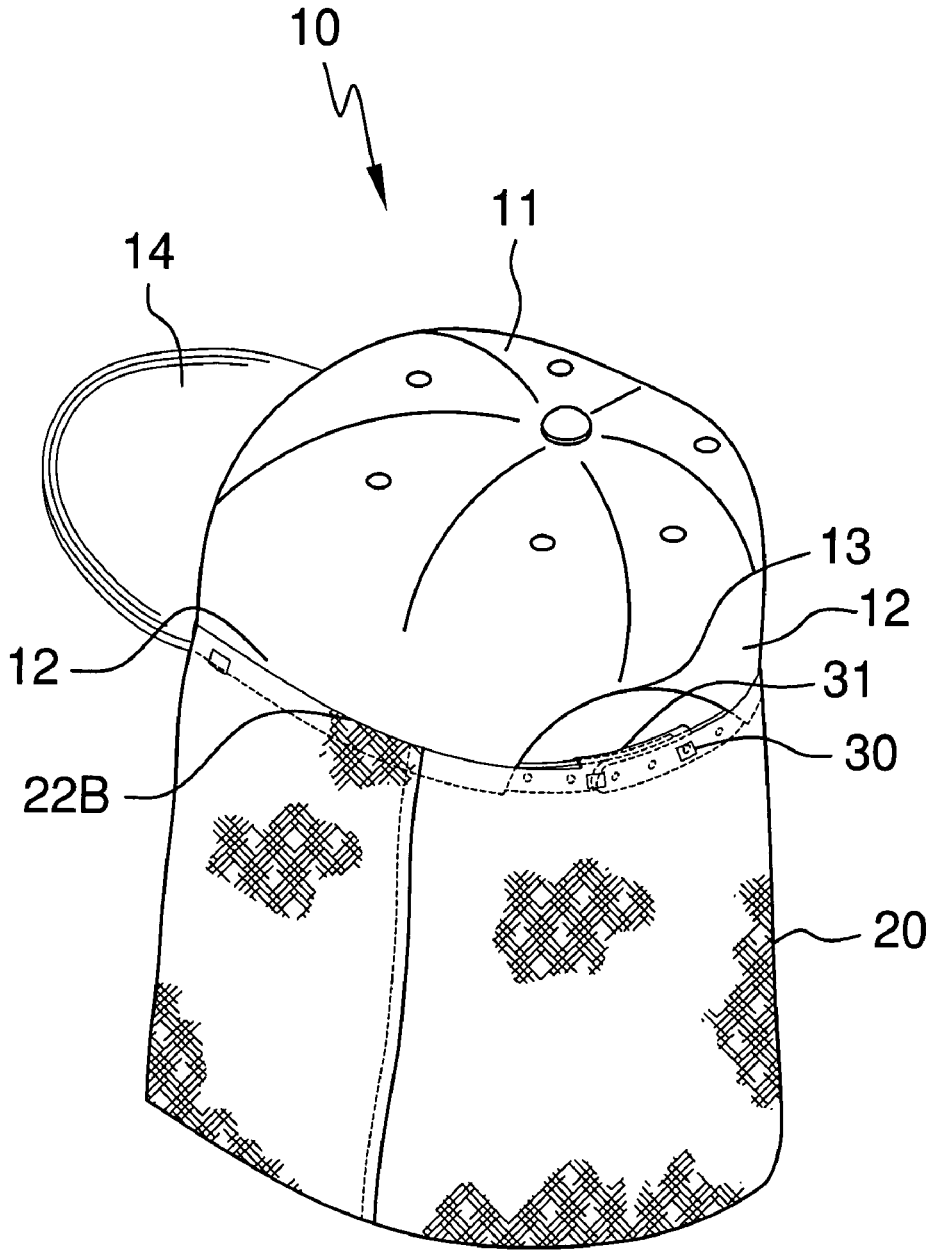
FIG. 1 is a perspective view showing a neck guard accessory for baseball caps and the like, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a neck guard accessory for baseball caps and the like. It should be understood that the apparatus 10 may be used to provide protection from sunrays on many different types of head covers and should not be limited in use to only baseball caps.

Referring initially to FIG. 1, the apparatus 10 includes a body 20 that has a plurality of monolithically formed panels 21 formed from UV blocking material, which is a critical feature for enabling the body 20 to protect the skin areas it covers from over exposure to sunlight. Of course, the body 20 may be produced in a variety of different shapes, sizes and colors, as is obvious to a person of ordinary skill in the art. Such a body 20 further has a centrally registered longitudinal axis extending substantially parallel to a bottom edge 12 of the cap 11.

Figure 2:
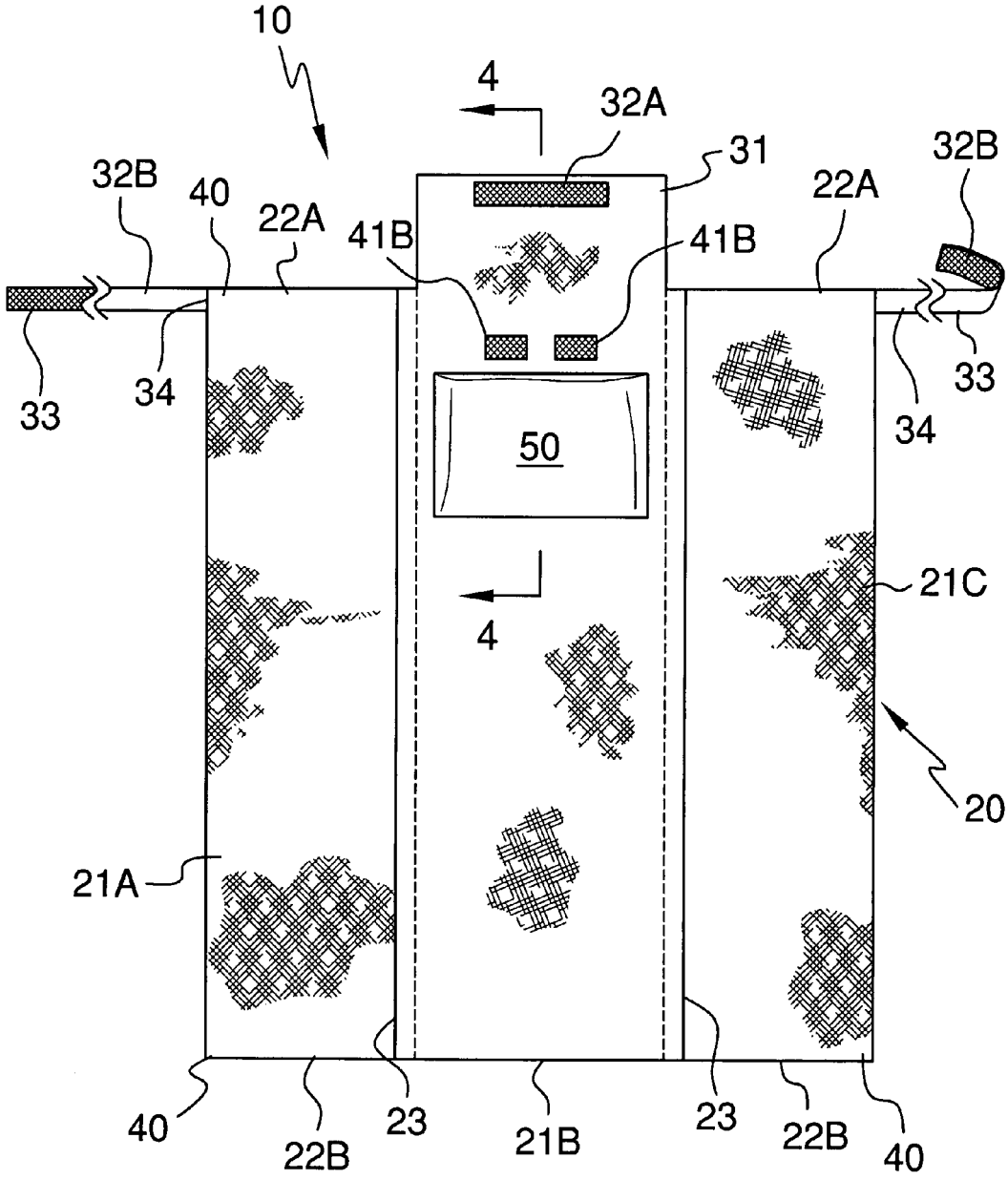
FIG. 2 is a front-elevational view of the apparatus shown in FIG. 1, showing the body at a fully extended state.

Referring to FIG. 2, the body 20 includes oppositely seated top 22A and bottom 22B edges registered parallel to the axis and equidistantly spaced therefrom. Such a body 20 further has a plurality of creases 23 linearly formed thereallong wherein the creases 23 extend orthogonal to the axis and define the panels 21 into first 21A, second 21B and third 21C panels respectively. The body 20 effectively covers the neck and extends from cheek-to-cheek and thereby covering the user's neck and ears. Such a body 20 has a uniform thickness and is formed from washable material, which is important and advantageous for allowing a user to periodically clean the apparatus 10 as needed. Advantageously, the first 21A, second 21B and third 21C panels overlap, which is critical for effectively allowing the user to adjust each panel independently of the other panel so that the width of the body 20 can be modified to protect the user's neck from UV lights.

Referring to FIGS. 1 through 4, a mechanism 30 is included for removably attaching the body 20 directly, with no intervening elements, to a rear portion 13 of the cap 11 such that the top edge 22A of the body 20 confronts and abuts the bottom edge 12 of the cap 13. The attaching mechanism 30 includes a flap 31 provided with a hook and loop fastener 32A. Such a flap 31 is monolithically formed with the top edge 22A of the body 20 and is suitably sized and shaped for wrapping about the rear portion 13 of the cap 11 and mating directly, with no intervening elements, with an interior surface 24 of the body 20.

The flap 31 is centrally registered on the second panel 21B and has a longitudinal axis orthogonally oriented with the axis of the body 20. A pair of coextensively shaped straps 33 have opposed end portions 34 directly coupled, with no intervening elements, to the top edge 22A of the body 20 and removably mateable with each other across a bill panel 14 of the cap 11. Such straps 33 are formed from flexible material and include hook and loop fasteners 32B, which is essential for advantageously allowing the user to quickly and efficiently adjust a position of the body 20 about the cap 11.

Figure 3:
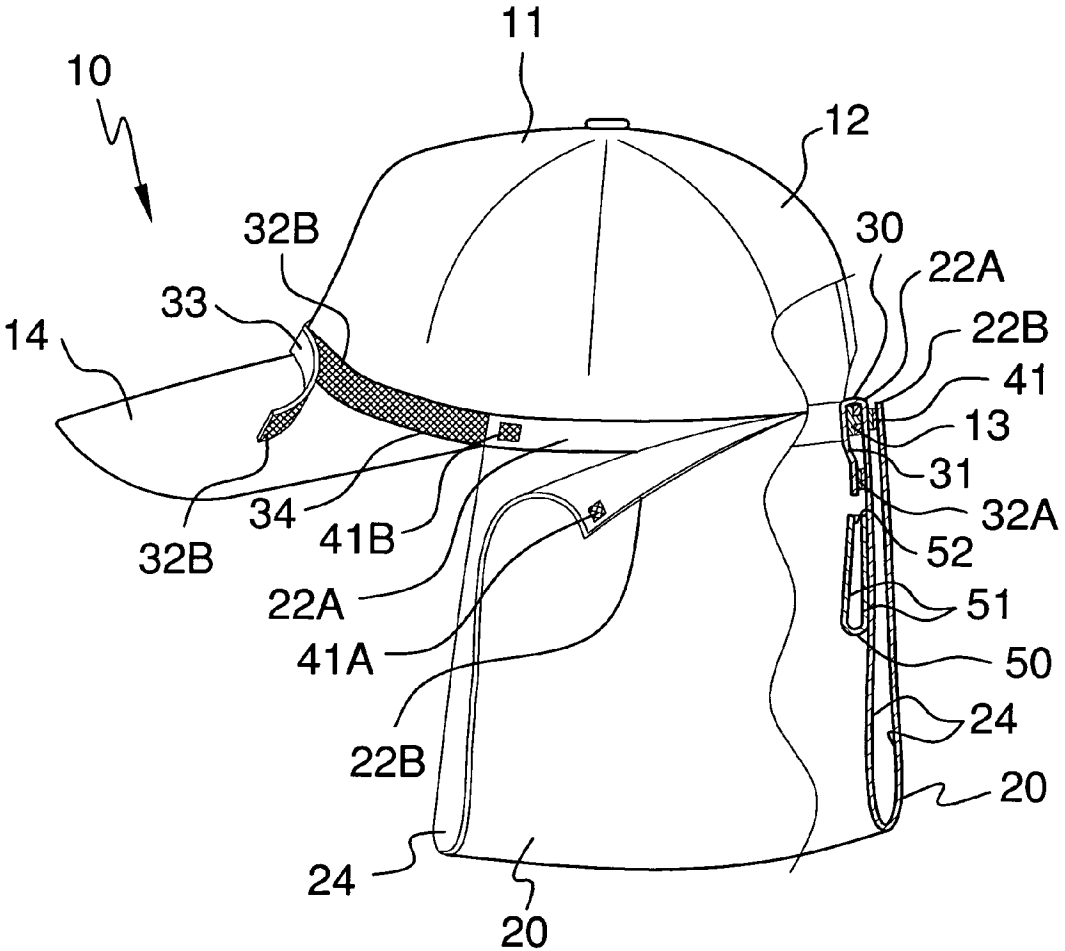
FIG. 3 is a partially exposed side-elevational view of the apparatus shown in FIG. 1.

Referring to FIGS. 2 and 3, a mechanism 40 is included for removably conjoining the bottom edge 22B of the body 20 directly, with no intervening elements, to the top edge 22A of the body 20 such that a length of the body 20 can conveniently and effectively be adjusted between a full length and one-half the full length as desired by the user. The conjoining mechanism 40 includes a first plurality of hook and loop fasteners 41A directly connected, with no intervening elements, to the bottom edge 22B of the body 20 and a second plurality of corresponding hook and loop fasteners 41B directly connected, with no intervening elements, to the top edge 22A of the body 20.

Such first 41A and second 41B fasteners are vertically aligned in such a manner that the body 20 can effectively be adapted to a raised and folded position by directly engaging, with no intervening elements, the first fasteners 41A to the second fasteners 41B. The attaching mechanism 30 and the conjoining mechanism 40 are simultaneously and independently adjustable. Advantageously, the present invention may be retrofitted onto a variety existing caps and the like, which is critical to advancing the intended function of the present invention.

Figure 4:
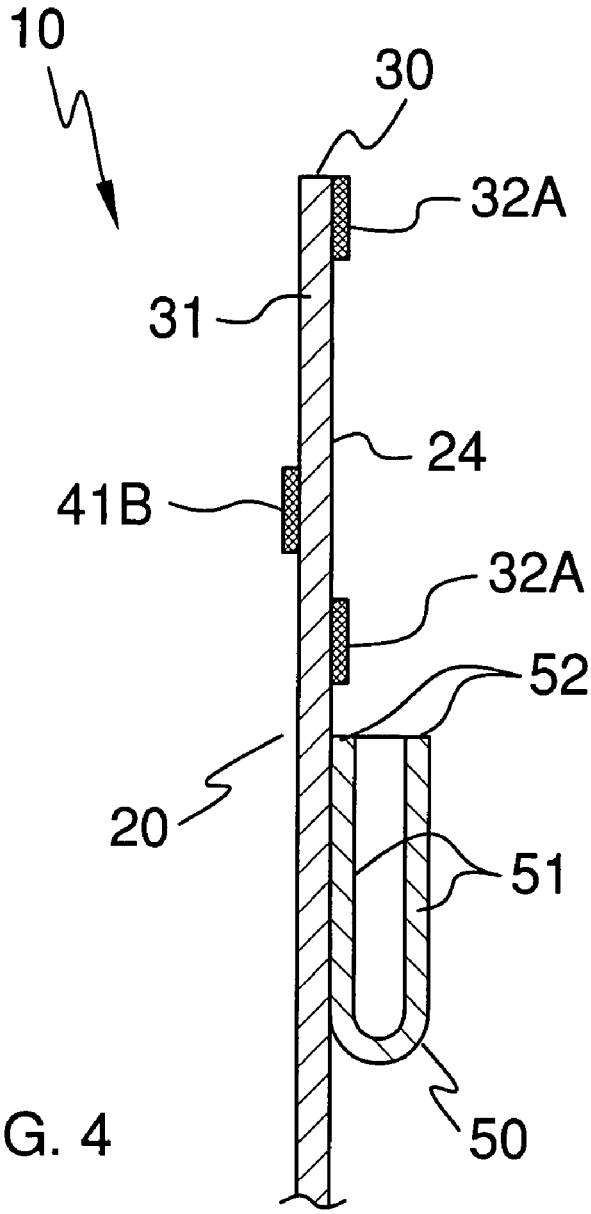
FIG. 4 is a cross-sectional view of the apparatus shown in FIG. 2, showing the storage pouch.
Figure 5:
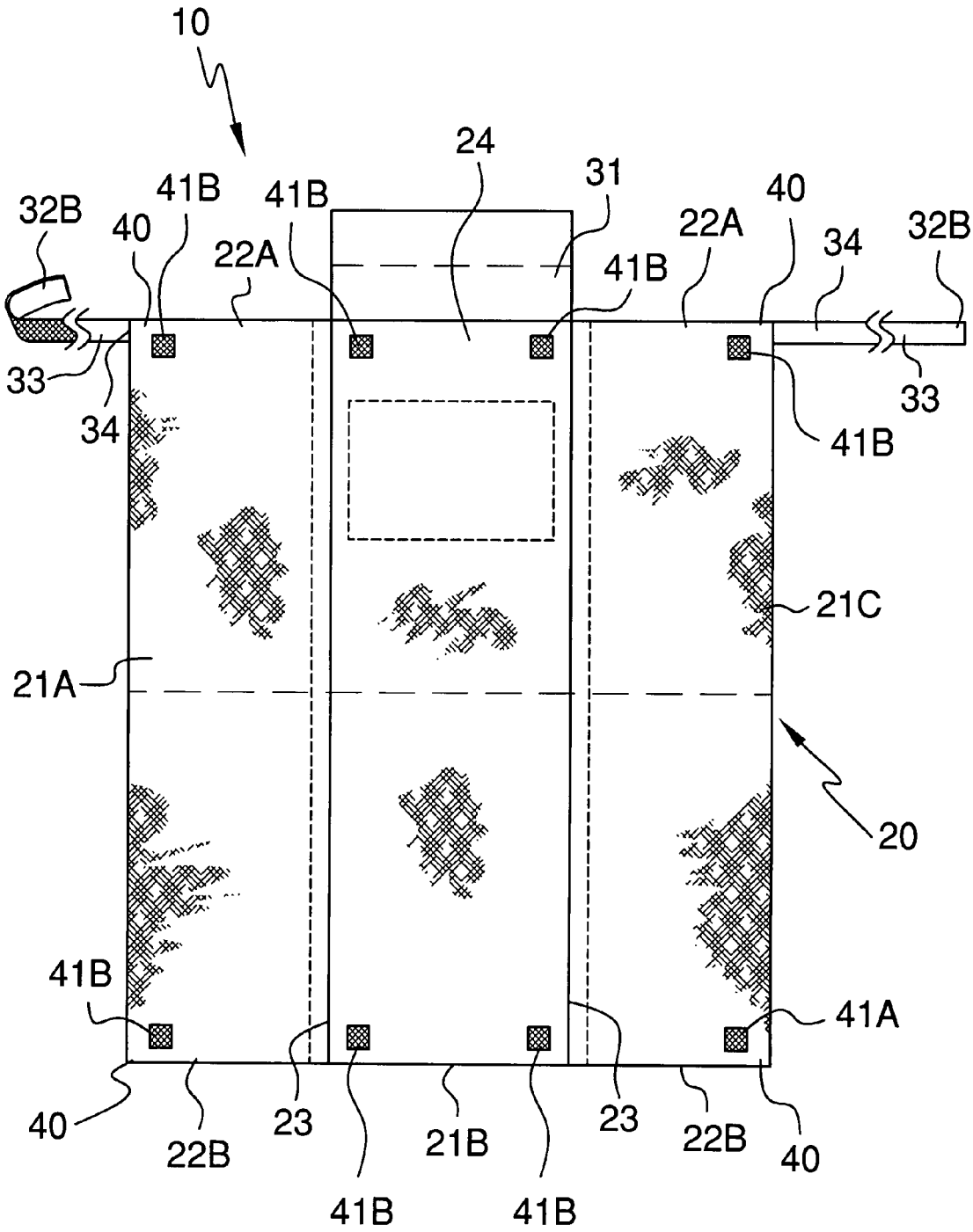
FIG. 5 is a rear elevational view of the apparatus shown in FIG. 2.

Referring to FIGS. 3, 4 and 5, a mechanism 50 is included for storing the body 20 at a folded position when the body 20 is detached form the cap 11 such that the body 20 becomes adapted to a rolled position after the first 21A and third 21C panels are folded inwardly over the second panel 21B. This feature is vital and advantageous for allowing the user to quickly and conveniently remove and store the apparatus 10 in their pocket or other suitable location, as their needs require. The storing mechanism 50 includes a pouch 51 directly conjoined, with no intervening elements, to an inner surface 24 of the body 20. Such a pouch 51 has a U-shape provided with an open top end 52. The pouch 51 is suitably sized and shaped for effectively receiving a major portion of the first 21A, second 21B and third 21C panels therein when the bottom edge 22B of body 20 is folded and rolled inwardly toward the top edge 22A. The first 41A and second 41B fasteners are detached when the body 20 is stored within the pouch 51.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A neck guard accessory removably attachable to an existing cap, said accessory comprising:

a body having a plurality of monolithically formed panels formed from UV blocking material, said body further having a centrally registered longitudinal axis extending substantially parallel to a bottom edge of the cap, said body including oppositely seated top and bottom edges registered parallel to the axis and equidistantly spaced therefrom, said body further having a plurality of creases linearly formed therealong wherein said creases extend orthogonal to the axis and define said panels into first, second and third panels respectively;

means for removably attaching said body directly to a rear portion of the cap such that said top edge of said body confronts and abuts said bottom edge of the cap;

means for removably conjoining said bottom edge of said body directly to said top edge of said body such that a length of said body can be adjusted between a full length and one-half the full length as desired by the user; and means for storing said body at a folded position when said body is detached from the cap such that said body becomes adapted to a rolled position after said first and third panels are folded inwardly over said second portion.

2. The apparatus of claim 1, wherein said attaching means comprises:

a flap provided with a hook and loop fastener, said flap being monolithically formed with said top edge of said body and suitably sized and shaped for wrapping about the rear portion of the cap and mating directly with an interior surface of said body, said flap being centrally registered between said second panel and having a longitudinal axis orthogonally oriented with the axis of said body; and a pair of coextensively shaped straps having opposed end portions directly coupled to said top edge of said body and removably mateable with each other across a bill panel of the cap, said straps being formed from flexible material and including hook and loop fasteners for allowing the user to quickly and efficiently adjust a position of said body about the cap.

3. The apparatus of claim 1, wherein said conjoining means comprises:

a first plurality of hook and loop fasteners directly connected to said bottom edge of said body; and a second plurality of corresponding hook and loop fasteners directly connected to said top edge of said body;

wherein said first and second fasteners are vertically aligned in such a manner that said body can be adapted to a raised and folded position by directly engaging said first fasteners to said second fasteners.

4. The apparatus of claim 3, wherein said storing means comprises:

a pouch directly conjoined to an inner surface of said body, said pouch having a U-shape provided with an open top end, said pouch being suitably sized and shaped for receiving a major portion of said first, second and third panels therein when said bottom edge of body is folded and rolled inwardly toward said top edge;

wherein said first and second fasteners are detached when said body is stored within said pouch.

5. The apparatus of claim 1, wherein said body has a uniform thickness and is formed from washable material.

6. A neck guard accessory removably attachable to an existing cap, said accessory comprising:

a body having a plurality of monolithically formed panels formed from UV blocking material, said body further having a centrally registered longitudinal axis extending substantially parallel to a bottom edge of the cap, said body including oppositely seated top and bottom edges registered parallel to the axis and equidistantly spaced therefrom, said body further having a plurality of creases linearly formed therealong wherein said creases extend orthogonal to the axis and define said panels into first, second and third panels respectively;

means for removably attaching said body directly to a rear portion of the cap such that said top edge of said body confronts and abuts said bottom edge of the cap;

means for removably conjoining said bottom edge of said body directly to said top edge of said body such that a length of said body can be adjusted between a full length and one-half the full length as desired by the user;

wherein said attaching means and said conjoining means are simultaneously and independently adjustable; and means for storing said body at a folded position when said body is detached from the cap such that said body becomes adapted to a rolled position after said first and third panels are folded inwardly over said second portion.

7. The apparatus of claim 6, wherein said attaching means comprises:

a flap provided with a hook and loop fastener, said flap being monolithically formed with said top edge of said body and suitably sized and shaped for wrapping about the rear portion of the cap and mating directly with an interior surface of said body, said flap being centrally registered between said second panel and having a longitudinal axis orthogonally oriented with the axis of said body; and a pair of coextensively shaped straps having opposed end portions directly coupled to said top edge of said body and removably mateable with each other across a bill panel of the cap, said straps being formed from flexible material and including hook and loop fasteners for allowing the user to quickly and efficiently adjust a position of said body about the cap.

8. The apparatus of claim 6, wherein said conjoining means comprises:

a first plurality of hook and loop fasteners directly connected to said bottom edge of said body; and a second plurality of corresponding hook and loop fasteners directly connected to said top edge of said body;

wherein said first and second fasteners are vertically aligned in such a manner that said body can be adapted to a raised and folded position by directly engaging said first fasteners to said second fasteners.

9. The apparatus of claim 8, wherein said storing means comprises:

a pouch directly conjoined to an inner surface of said body, said pouch having a U-shape provided with an open top end, said pouch being suitably sized and shaped for receiving a major portion of said first, second and third panels therein when said bottom edge of body is folded and rolled inwardly toward said top edge;

wherein said first and second fasteners are detached when said body is stored within said pouch.

10. The apparatus of claim 6, wherein said body has a uniform thickness and is formed from washable material.

11. A neck guard accessory removably attachable to an existing cap, said accessory comprising:

a body having a plurality of monolithically formed panels formed from UV blocking material, said body further having a centrally registered longitudinal axis extending substantially parallel to a bottom edge of the cap, said body including oppositely seated top and bottom edges registered parallel to the axis and equidistantly spaced therefrom, said body further having a plurality of creases linearly formed therealong wherein said creases extend orthogonal to the axis and define said panels into first, second and third panels respectively, wherein said body covers the neck and extends from cheek-to-cheek and thereby covering the user's neck and ears;

means for removably attaching said body directly to a rear portion of the cap such that said top edge of said body confronts and abuts said bottom edge of the cap;

means for removably conjoining said bottom edge of said body directly to said top edge of said body such that a length of said body can be adjusted between a full length and one-half the full length as desired by the user;

wherein said attaching means and said conjoining means are simultaneously and independently adjustable; and means for storing said body at a folded position when said body is detached from the cap such that said body becomes adapted to a rolled position after said first and third panels are folded inwardly over said second portion.

12. The apparatus of claim 11, wherein said attaching means comprises:

a flap provided with a hook and loop fastener, said flap being monolithically formed with said top edge of said body and suitably sized and shaped for wrapping about the rear portion of the cap and mating directly with an interior surface of said body, said flap being centrally registered between said second panel and having a longitudinal axis orthogonally oriented with the axis of said body; and a pair of coextensively shaped straps having opposed end portions directly coupled to said top edge of said body and removably mateable with each other across a bill panel of the cap, said straps being formed from flexible material and including hook and loop fasteners for allowing the user to quickly and efficiently adjust a position of said body about the cap.

13. The apparatus of claim 11, wherein said conjoining means comprises:

a first plurality of hook and loop fasteners directly connected to said bottom edge of said body; and a second plurality of corresponding hook and loop fasteners directly connected to said top edge of said body;

wherein said first and second fasteners are vertically aligned in such a manner that said body can be adapted to a raised and folded position by directly engaging said first fasteners to said second fasteners.

14. The apparatus of claim 13, wherein said storing means comprises:

a pouch directly conjoined to an inner surface of said body, said pouch having a U-shape provided with an open top end, said pouch being suitably sized and shaped for receiving a major portion of said first, second and third panels therein when said bottom edge of body is folded and rolled inwardly toward said top edge;

wherein said first and second fasteners are detached when said body is stored within said pouch.

15. The apparatus of claim 11, wherein said body has a uniform thickness and is formed from washable material.

* * * * *